US006920728B2

(12) United States Patent
Powers

(10) Patent No.: US 6,920,728 B2
(45) Date of Patent: Jul. 26, 2005

(54) COLUMN AND BEAM CONSTRUCTION AND METHOD

(76) Inventor: James M. Powers, 3 Santa Lucia Ave., Ormond Beach, FL (US) 32174

( * ) Notice: Subject to any disclaimer, the term of this patent is extended or adjusted under 35 U.S.C. 154(b) by 0 days.

(21) Appl. No.: 10/336,902

(22) Filed: Jan. 6, 2003

(65) Prior Publication Data

US 2004/0055246 A1 Mar. 25, 2004

Related U.S. Application Data

(60) Provisional application No. 60/413,135, filed on Sep. 25, 2002.

(51) Int. Cl.[7] ..... E04B 1/00

(52) U.S. Cl. ..... 52/250; 52/251; 52/259; 52/742.14; 52/236.5; 52/677; 52/649.1; 52/260; 52/649.2; 52/252

(58) Field of Search ..... 52/250, 251, 259, 52/742.14, 236.5, 378, 677, 649.1, 260, 649.2, 252, 253, 223.7

(56) References Cited

U.S. PATENT DOCUMENTS 2,143,616 A * 1/1939 Adler ..... 52/423
3,613,325 A * 10/1971 Yee ..... 52/236.8
4,081,935 A * 4/1978 Wise ..... 52/236.8
4,330,970 A * 5/1982 Bonink ..... 52/125.4
4,333,285 A * 6/1982 Koizumi et al. ..... 52/252
5,367,854 A * 11/1994 Kim ..... 52/745.13
5,553,430 A * 9/1996 Majnaric et al. ..... 52/236.8
5,809,712 A * 9/1998 Simanjuntak ..... 52/223.7
6,293,063 B2 * 9/2001 Van Doren ..... 52/251
6,385,930 B1 5/2002 Broms et al.

OTHER PUBLICATIONS

Carl Eric . . . "Punching of Flat Plates",ACI Structural Journal, V. 87, No. 3, May–Jun., pp. 292–304.

* cited by examiner

*Primary Examiner*—Carl D. Friedman
*Assistant Examiner*—Nahid Amiri

(57) ABSTRACT

Site cast or pre-cast columns aligned and braced by pre-cast pre-stressed floor beams are used to erect a concrete skeleton structure for a building. The ends of the horizontal beams are imbedded in the columns at floor levels to stabilize and complete the skeleton. The horizontal beams are pre-stressed and are cast with passages that permit insertion of continuous reinforcing tendons into a network throughout each floor level. The tendons are subsequently post-tensioned so to tie the beams together and to the columns to reinforce the skeleton. Slab drop-forms starting at the roof and progressing floor-by-floor downward allow monolithic post-tensioned floor slabs to be cast to tie the skeleton into a unitary structure. The beams are usually integrated (buried) into each monolithic floor slab, keyed, doweled and bonded with bonding agent at cold joints to become a part of the slab structure.

5 Claims, 9 Drawing Sheets

10a
126
128

COLUMN AND BEAM CONSTRUCTION AND METHOD

CROSS-REFERENCE TO RELATED APPLICATIONS

This application claims priority under 35 U.S.C. 119 of U.S. Provisional Application No. 60/413,135 filed on Sep. 25, 2002, the entire disclosure of which is hereby incorporated by reference.

BACKGROUND OF THE INVENTION

1. Field of the Invention

This invention relates to concrete building construction comprised of column-supported concrete slabs. The present innovation imbeds ends of pre-cast horizontal beams at floor levels in all columns to stabilize and complete a skeleton. Site-cast roof and floors may subsequently be formed and poured sequentially from the top down, efficiently reusing the formwork by simply lowering forms for floor spans between the floor beams of the skeleton floor by floor as the upper floors are finished. The specialized pre-cast floor beams are essential to the invention.

2. Identification of Background Art

Broms, Carl Eric, "Punching of Flat Plates, ACI Structural Journal, V. 87, No. 3, May–June, pp. 292–304. U.S. Pat. No. 6,385,930 issued to Broms et al.

SUMMARY AND OBJECTS OF THE INVENTION

The present invention utilizes pre-cast or site-cast columns aligned and braced by pre-cast pre-stressed floor beams to erect a concrete skeleton structure for a building. The present innovation imbeds ends of pre-cast horizontal beams at floor levels in all columns to stabilize and complete the skeleton. The resulting skeleton utilizes pre-cast horizontal beams that are pre-stressed and cast with passages or ducts that permit insertion of continuous reinforcing tendons into a network throughout each floor level. Said tendons are subsequently post-tensioned so to tie the beams together and to the columns to reinforce the skeleton. Slab drop-forms starting at the roof and progressing floor-by-floor downward allow post-tensioned floor slabs to tie the skeleton into a unitary structure. The beams are usually integrated (buried) into each monolithic floor slab, keyed, doweled and bonded with bonding agent at cold joints to become a part of the slab structure.

Objects and advantages of my invention are:

It utilizes simple reusable forms and pre-cast components in rapid sequence for quick erection.

Small section building components require only small capacity lifting equipment.

Top down roof and floor construction protects subsequent construction and finishes from water and weather damage.

The objects of the invention and others as well are realized by a method for constructing a building having upright columns and slabs transversely spanning and supported by the columns, the method comprising the steps of: a) providing column sections or column forms bounding spaces for the columns; b) arranging pre-cast beams so as to span the distance between adjacent columns at a predetermined level of the columns, the beams forming a transverse grid of spaced beams, the ends of each beam intruding into the space bounded by a column exterior; c) pouring concrete into the forms to form columns that envelop the beam ends or erecting precast column sections that ennclose the ends of each beam; d) providing elongated reinforcing elements that extend (1) within the beams along the length of the beams and (2) between the beam ends within the columns, the reinforcing elements being unbonded to the beams and to the concrete in the columns, whereby the reinforcing elements can move within the beams and the columns during a post-tensioning operation; e) arranging slab forms transversely between the beams and the columns at the predetermined level of the beams; and f) pouring concrete into the slab forms to form the slabs.

Objects and advantages of embodiments of the present invention are disclosed herein. Still further objects and advantages will become apparent from a consideration of the ensuing description and accompanying drawings.

DETAILED DESCRIPTION OF PREFERRED EMBODIMENTS

Pre-cast column sections (FIG. 8) for the first floor are erected upon the foundation rising to the level of the next floor. The column sections contain pockets (FIG. 8*a*) for pre-cast floor beam ends imbedded in the column and joined at weld plates cast into column and beam (FIGS. 8*c, d*, and *e*) and steel dowels (FIG. 3*c*) passing vertically through holes (FIG. 5*a*) in the beams about 18 inches into the column below and an equal distance into the column above and grouted into the column.

Figure 1:
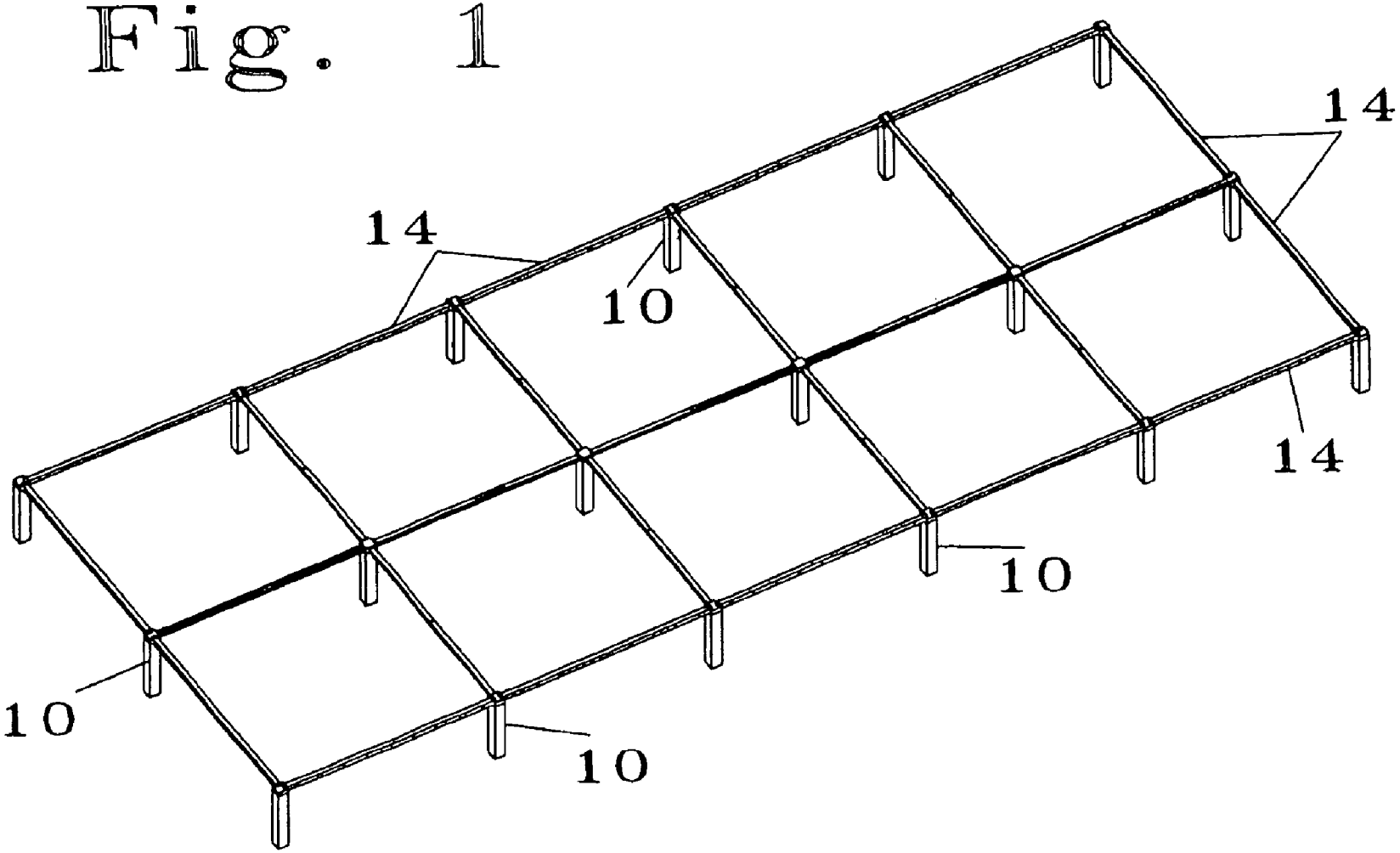
FIG. 1 illustrates the column and beam placement for the first floor of a building constructed according to the present invention.
Figure 2:
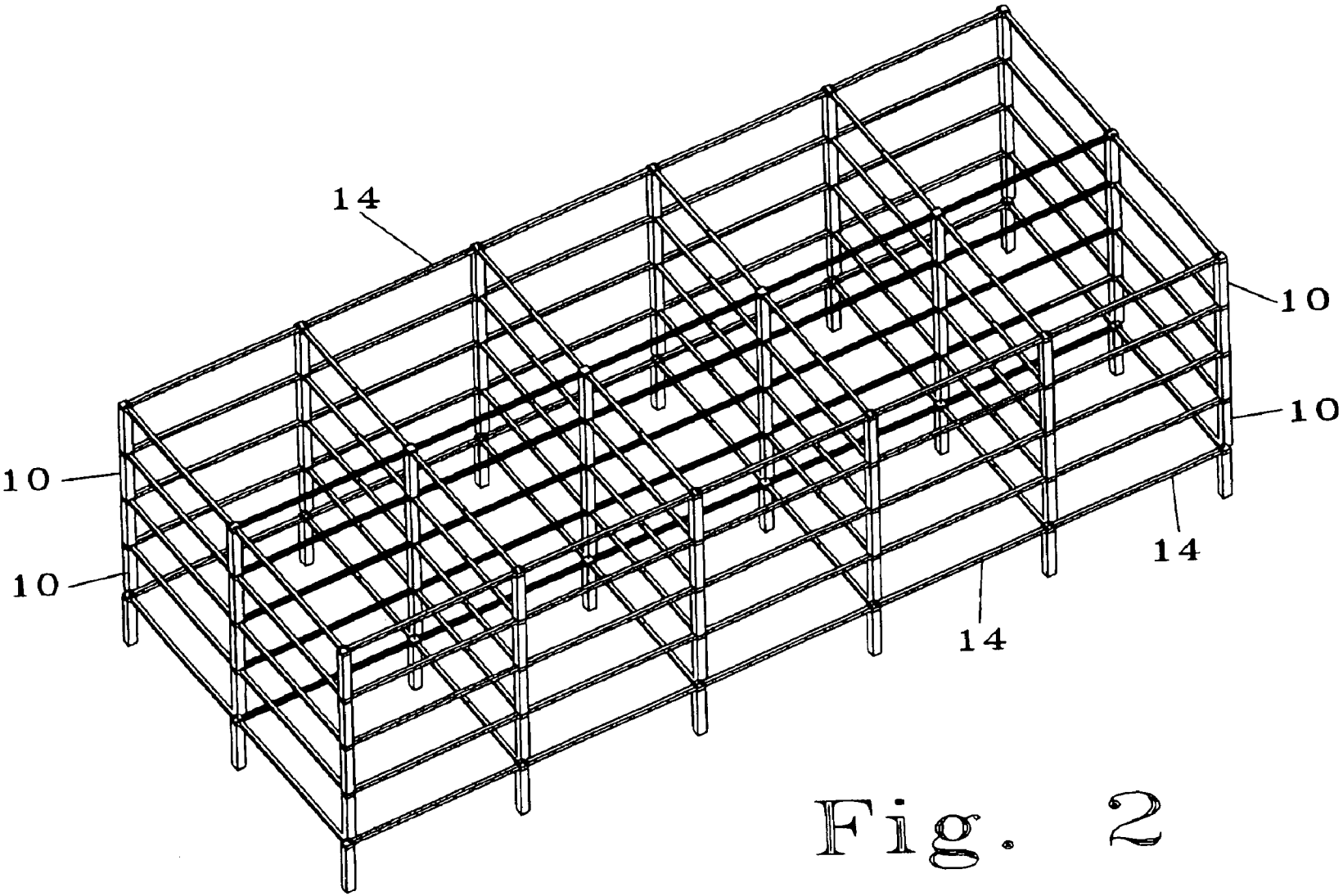
FIG. 2 illustrates a four-floor skeleton of a building constructed according to the present invention, before forming roof and floor slabs.
Figure 3:
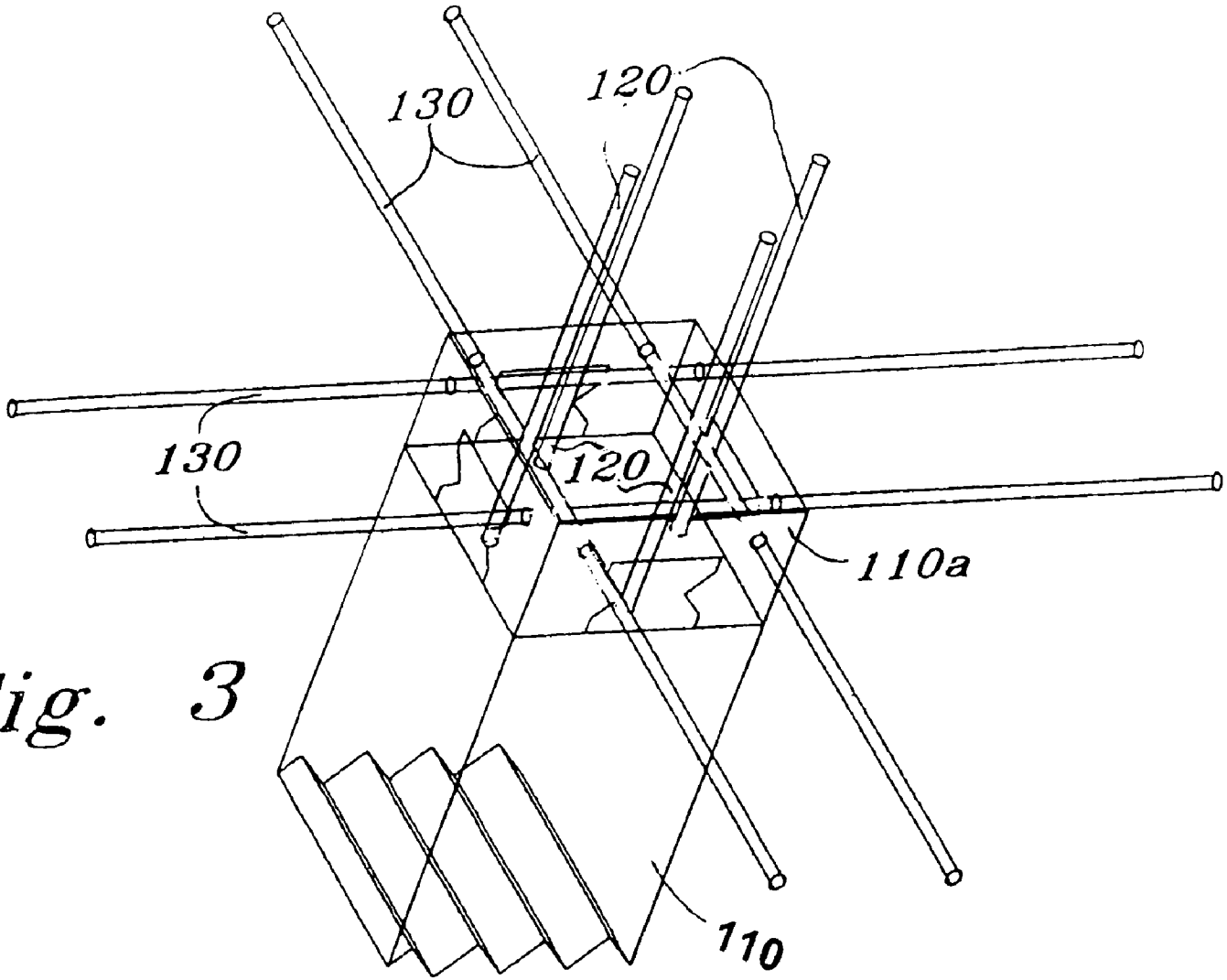
FIG. 3 illustrates details of forming the column-beam joint.
Figure 4:
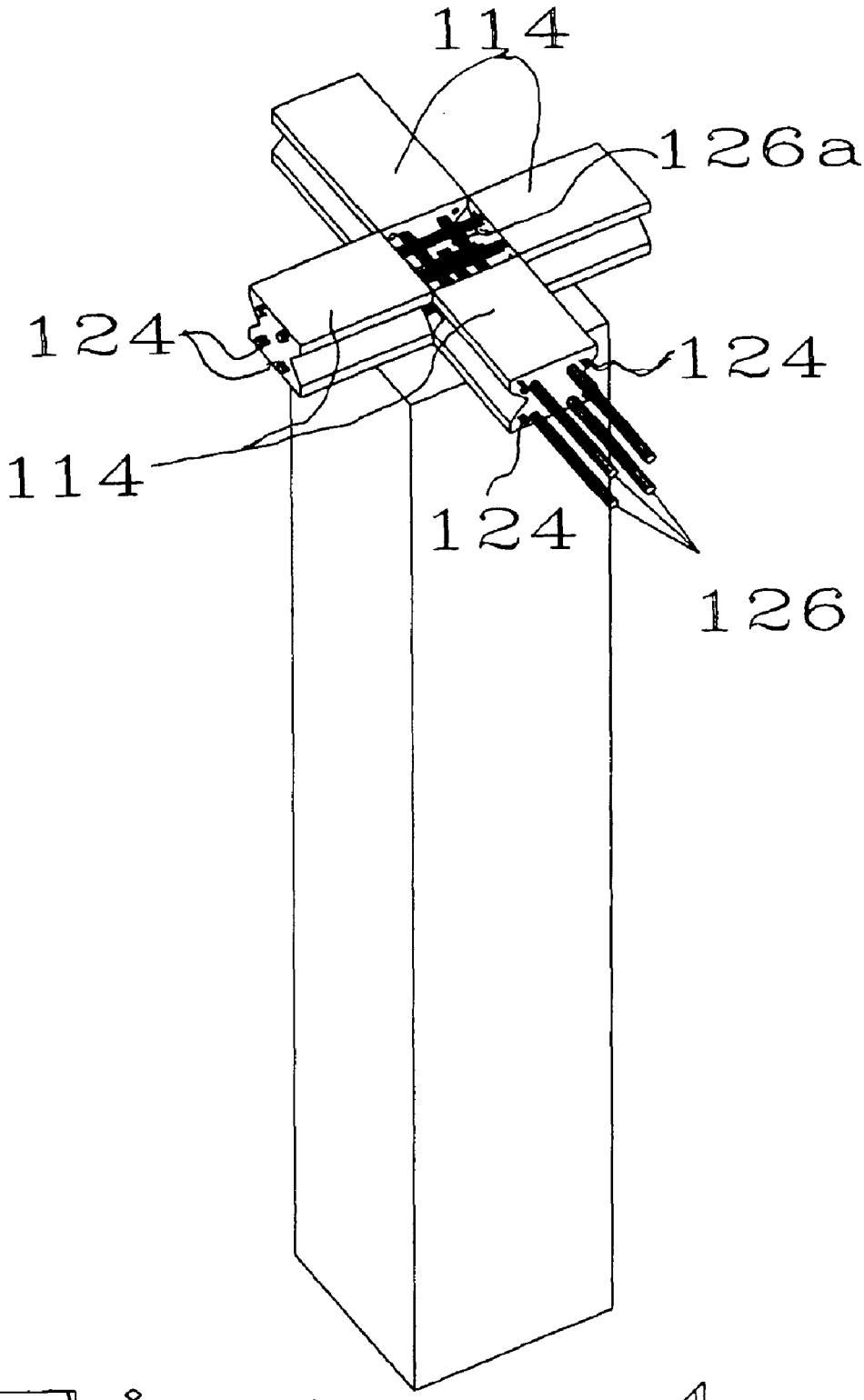
FIG. 4 illustrates details of the column-beam joint.
Figure 6:
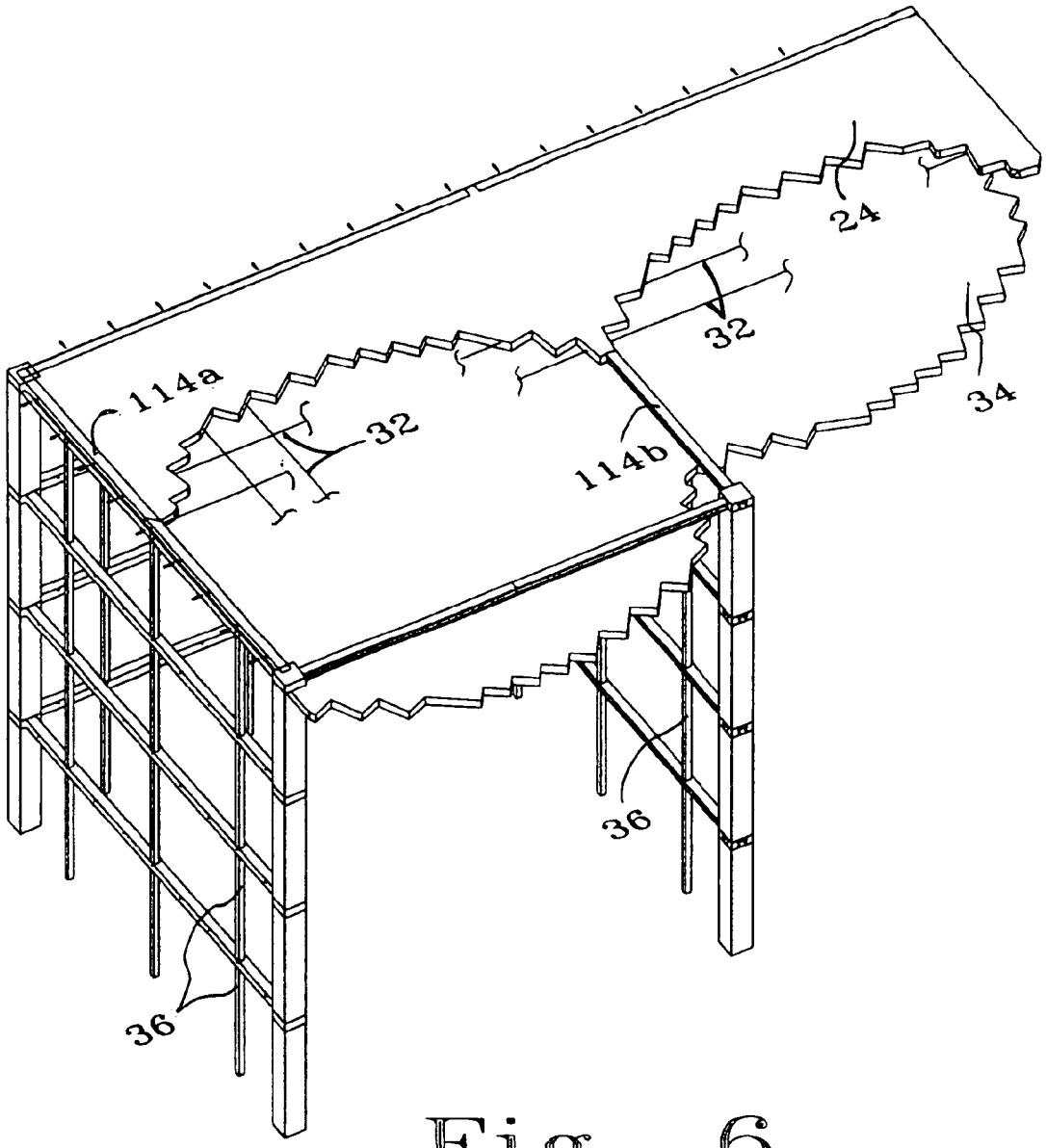
FIG. 6 illustrates details of a slab form.
Figure 8:
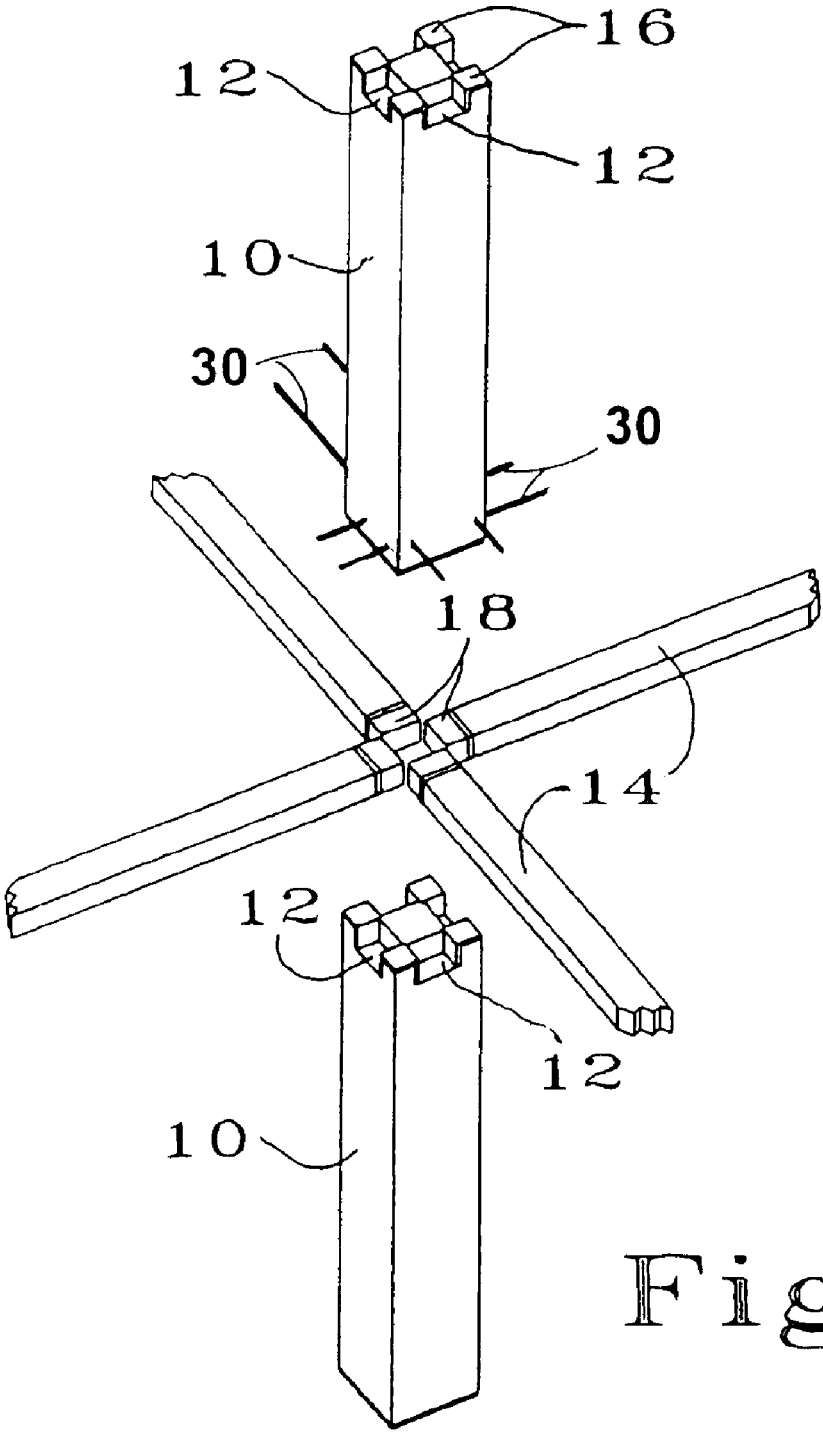
FIG. 8 illustrates details of preferred pre-cast column sections and beam ends poised above pre-cast beam pockets.
Figure 9:
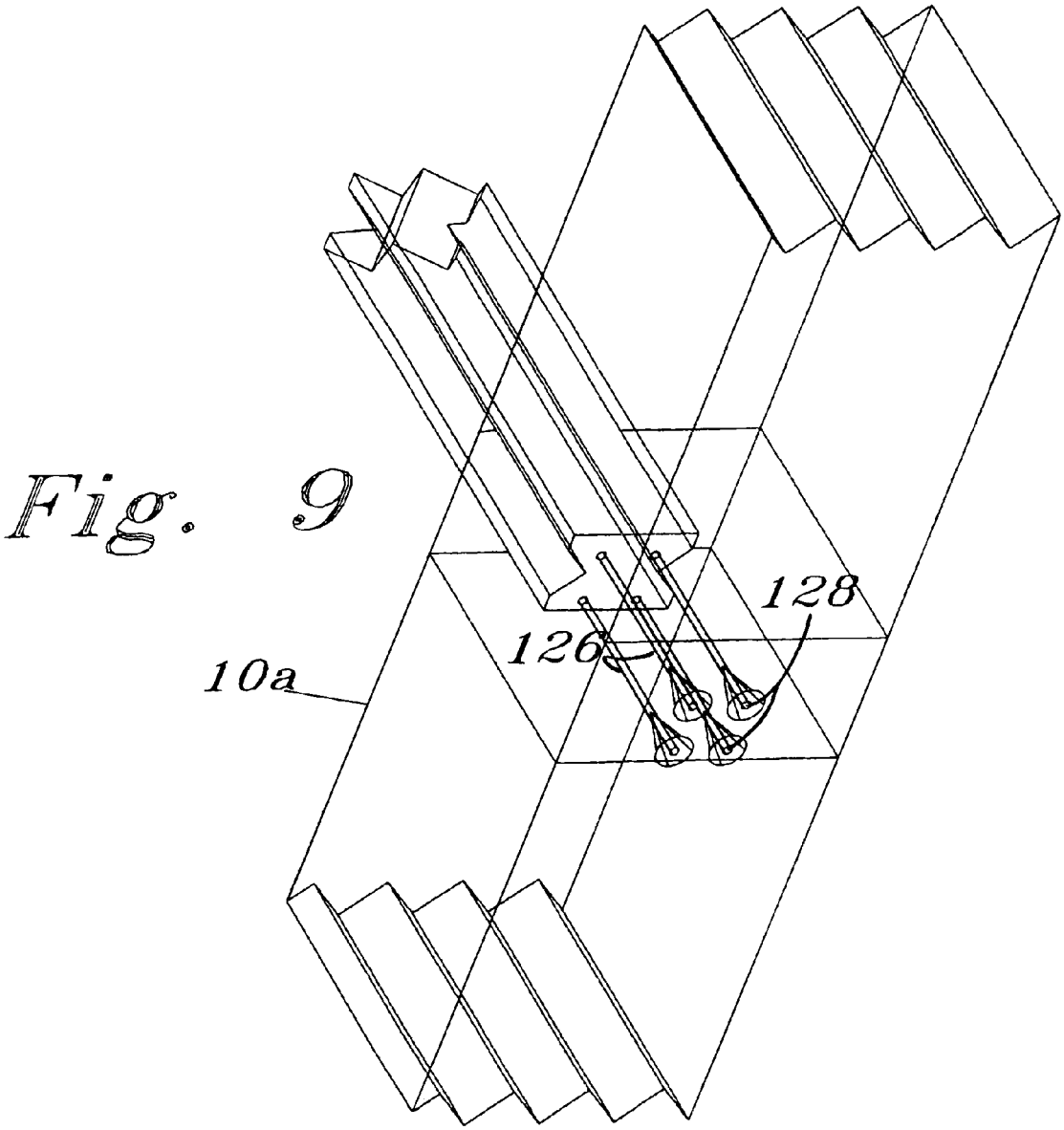
FIG. 9 illustrates anchors for unbonded beam tendons terminating in perimeter columns.

The pre-cast beams are an essential part of the invention. They are to be totally incorporated in a post-tensioned monolithic concrete slab 24, as shown in FIG. 6, to be subsequently poured sequentially from the roof down after the skeleton is erected. As shown in FIG. 4, the beams 114, which are pre-stressed, each contain four tendons 124 that are bonded to the material forming the beam and are cut to beam length. Still referring to FIG. 4, and also to FIG. 9, beams 114 also each contain passages formed, for example, by PVC ducts 126 for subsequent insertion of four unbonded (post-tensioned) tendons 128 running continuously end-to-end and side-to-side in the building, passing through sleeves 126A in every column tic-tac-toe fashion. As shown in FIG. 9, the unbonded tendons 128 are terminated and anchored in perimeter columns 10*a*. As shown in FIGS. 3 and 8, heavy steel dowels 30, 130 pass horizontally through the columns and are grouted into the columns projecting into the floor space where they will help the beams lock the floors into the columns. The unbonded tendons, pre-stressed beam ends and the steel dowels provide extraordinary resistance to punching shear by the columns.

Perimeter beams (FIG. 7*a*) are floor thickness. The interior beams are designed with 2 or 3 inches clearance below floor level ((FIG. 7*b*) so that shrouded unbonded tendons can be draped across them and crossed two ways in floor forms and anchored (FIG. 6*c*) in perimeter beams to create a monolithic slab (FIG. 6*a*) across and burying all the beams creating a unitary structure tying beams, floor and columns together. The skeleton is supported with temporary vertical shoring (FIG. 6*b*) until reusable drop forms supported by said shoring allows casting the roof slab first and by lowering the drop forms, subsequently each of the floor slabs in sequence from top to bottom.

The skeleton of a typical 40,000 sq. ft. structure requires approximately 200 cubic yards of concrete exclusive of slabs, foundation and shear bracing.

In the construction method as disclosed in the foregoing description of preferred embodiments of the invention, and with particular reference to FIGS. 3, 4, 5 and 9, with the ends of beams 114 intruding into a form 110*a*, short sleeves 126*a* are arranged in tic-tac-toe fashion within form 110*a* between confronting beam ends and in alignment with passages formed by PVC ducts 126 within the beams 114. Elongated reinforcing elements, such as tendons 128, are provided within the ducts 126 in the beams 114 along the lengths thereof. These reinforcing elements extend through the sleeves 126*a* within the form 110*a* between the beam ends. By virtue of the PVC ducts 126 and the sleeves 126*a*, the reinforcing elements are free of bonds, i.e., are unbonded, to the beams 114 and to concrete subsequently poured in the form 110*a*.

Figure 7:
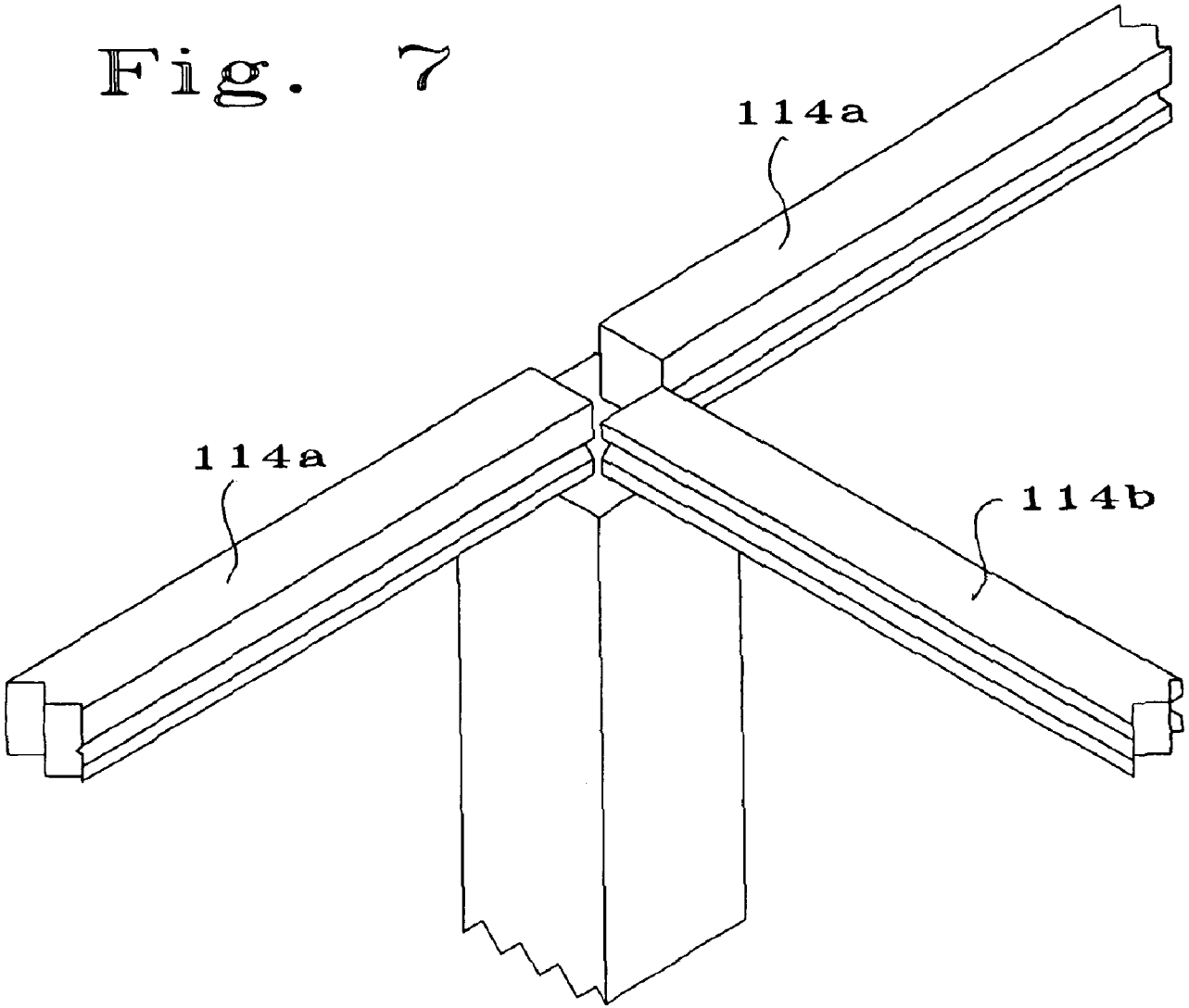
FIG. 7 illustrates details of a joint between perimeter beams with tendon anchors and thinner interior beam aligned on a column.

According to another aspect of the construction method disclosed herein, with reference to FIGS. 6, 7 and 9, elongated reinforcing elements 32 are provided within a floor slab 24. These reinforcing elements extend into and terminate in perimeter beams 114*a* located at a perimeter edge of the floor slab. A first set of the reinforcing elements within the floor slab are oriented in a first direction, and a second set of the reinforcing elements within the floor slab are oriented in a second direction that is generally orthogonal to the first direction. Anchoring elements of well-known design are secured to the perimeter beams for gripping the ends of the reinforcing elements within the floor slab and for effecting a post-tensioning operation on the reinforcing elements within the floor slab. Anchoring elements are also provided within perimeter columns 10*a* located at a perimeter edge of the floor slab for gripping the ends of the reinforcing elements in the beams and for effecting a post-tensioning operation on the reinforcing elements in the beams.

According to another aspect of the construction method disclosed herein, with particular reference to FIGS. 1, 2, 6 and 8, pre-cast column sections 10 are provided for supporting a floor. The column sections have beam pockets 12 formed therein and are provided with metal inserts 16 at the level of the beam pockets. Pre-cast beams 14 are arranged so as to span the distance between adjacent column sections at the level of the beam pockets and form a transverse grid of spaced beams. The ends of the beams intrude into the beam pockets and are provided with metal inserts 18. The metal inserts in the beams are fastened to the metal inserts in the column sections. Elongated reinforcing elements, like the reinforcing elements 128 shown in FIG. 9, are provided within the beams 14, extending within the beams along the length of the beams and between the beam ends within the column sections, in the manner shown in FIG. 4. These reinforcing elements are unbonded to the beams and to the concrete in the columns, whereby the reinforcing elements can move within the beams and the columns during a post-tensioning operation. Slab forms 34 are arranged transversely between the beams and the columns. Thereafter, concrete is poured into the slab forms to form the slab 24. As best shown in FIGS. 6, 7 and 9, elongated reinforcing elements 32 are provided within a floor slab 24. These reinforcing elements extend into and terminate in perimeter beams 114*a* located at a perimeter edge of the floor slab. A first set of the reinforcing elements within the floor slab are oriented in a first direction, and a second set of the reinforcing elements within the floor slab are oriented in a second direction that is generally orthogonal to the first direction. Anchoring elements of well-known design are secured to the perimeter beams for gripping the ends of the reinforcing elements within the floor slab and for effecting a post-tensioning operation on the reinforcing elements within the floor slab. Anchoring elements are also provided within perimeter columns 10*a* located at a perimeter edge of the floor slab for gripping the ends of the reinforcing elements in the beams and for effecting a post-tensioning operation on the reinforcing elements in the beams.

Figure 5:
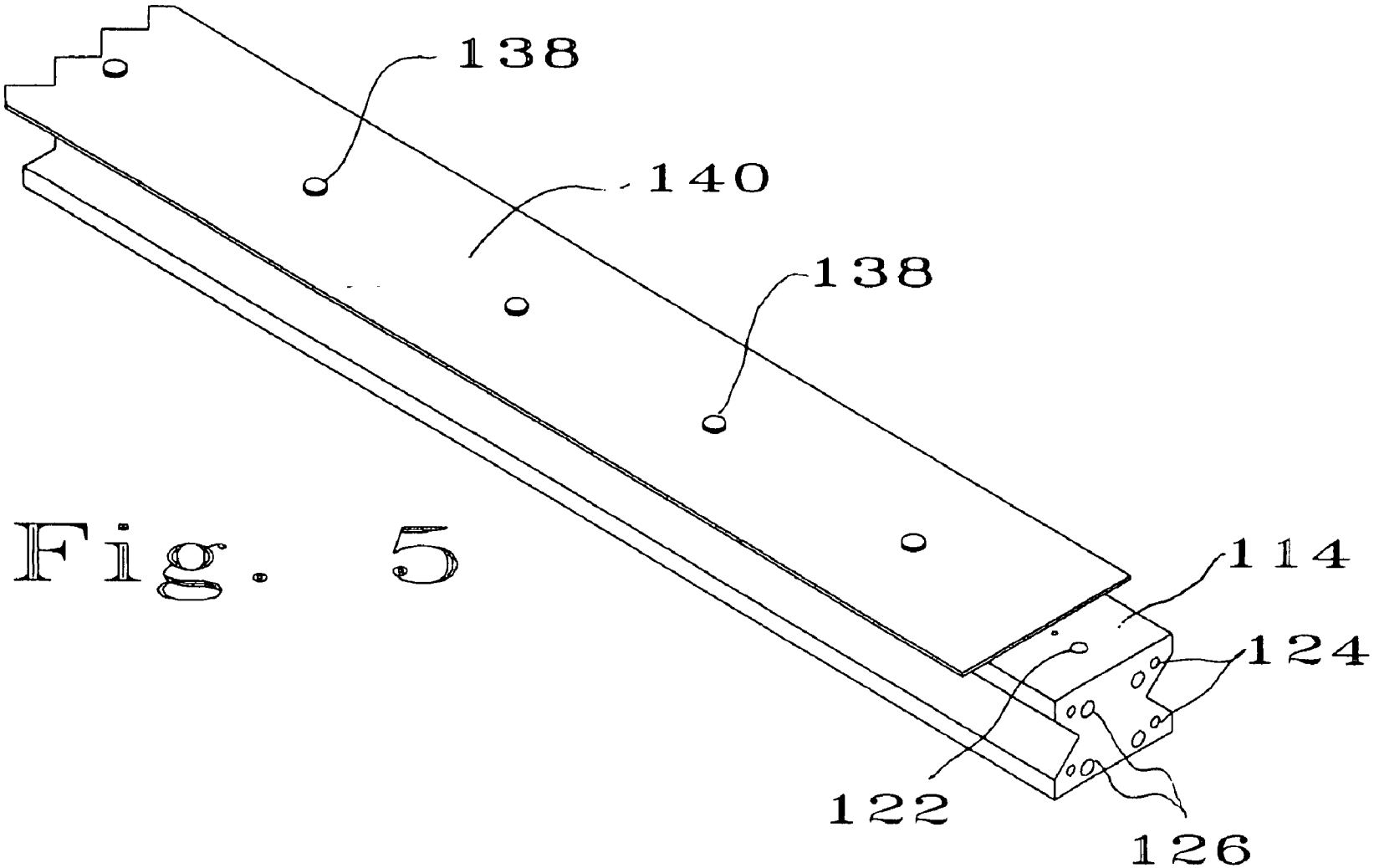
FIG. 5 illustrates bottom view of a beam, showing dowel hole, beam-end form alignment detent, slab form dams and their beam fastenings.

To recap and amplify, the pre-cast beams provide alignment and lateral bracing for the columns and facilitate the casting of the floors. As shown in FIG. 5, column spacing and screw anchors 138 for attaching temporary slab form dams 140 are designed into the beams at the start. The form dams seal drop forms against the surrounding beams for pouring. As shown in FIG. 4, extensions of the PVC ducts 126, crossing tic-tac-toe fashion in the columns, are formed by short sleeves 126*a* provided during assembly before pouring, if the columns are site cast, to keep the ducts clear of concrete. Shear bracing can be by any method common in the industry.

The support for a floor slab form in this embodiment is shown in FIG. 6. in which floor slab form is mounted on shoring.

OTHER EMBODIMENTS

Optional site cast columns instead of precast. FIGS. 3, 4, 5 and 7 illustrate details representative of site cast columns as well as of precast columns.

Beams that although embedded in a slab, also project into ceiling space below slab permitting longer spans between columns.

What is claimed is:

1. A method for constructing a building having upright columns and slabs transversely spanning and supported by the columns, the method comprising the steps of:

a) providing column forms bounding spaces for the columns;

b) arranging pre-cast beams so as to span the distance between adjacent forms at a predetermined level of the columns, the beams forming a transverse grid of spaced beams, the ends of each beam intruding into the space bounded by a form;

c) pouring concrete into the forms to form columns that envelop the beam ends;

d) providing elongated reinforcing elements that extend (1) within the beams along the length of the beams and (2) between the beam ends within the forms, the reinforcing elements being unbonded to the beams and to the concrete in the formed columns, whereby the reinforcing elements can move within the beams and the columns during a post-tensioning operation;

e) arranging slab forms transversely between the beams and the columns at the predetermined level of the columns; and f) pouring concrete into the slab forms to form the slab.

2. The method as recited in claim 1, wherein passages for the reinforcing elements are provided in the beams, and further comprising the following step performed before step c):

providing sleeves in the column forms, the sleeves extending between confronting beam ends and disposed in alignment with the passages, the elongated reinforcing elements provided in step d) being inserted through the passages and through the sleeves.

3. The method as recited in claim 1, and further comprising the following steps:

providing unbonded elongated reinforcing elements within a floor slab, the reinforcing elements within the floor slab extending into and terminating in perimeter beams located at a perimeter edge of the floor slab, a first set of the reinforcing elements within the floor slab oriented in a first direction, and a second set of the reinforcing elements within the floor slab oriented in a second direction that is generally orthogonal to the first direction;

providing anchoring elements secured to the perimeter beams for gripping the ends of the reinforcing elements within the floor slab and for effecting a post-tensioning operation on the reinforcing elements within the floor slab; and providing anchoring elements within perimeter columns located at a perimeter edge of the floor slab for gripping the ends of the reinforcing elements in the beams and for effecting a post-tensioning operation on the reinforcing elements in the beams.

4. A method for constructing a building having upright columns and slabs transversely spanning and supported by the columns, the method comprising the steps of:

a) erecting pre-cast column sections for supporting a floor, the column sections having beam pockets formed therein and being provided with metal inserts at the level of the beam pockets;

b) arranging pre-cast beams so as to span the distance between adjacent column sections at the level of the beam pockets, the beams forming a transverse grid of spaced beams, the ends of each beam intruding into the beam pockets and being provided with metal inserts;

c) fastening the metal inserts in the beams to the metal inserts in the column sections;

d) providing elongated reinforcing elements that extend (1) within the beams along the length of the beams and (2) between the beam ends within the column sections, the reinforcing elements being unbonded to the beams and to the concrete in the columns, whereby the reinforcing elements can move within the beams and the columns during a post-tensioning operation;

e) arranging slab forms transversely between the beams and the columns; and f) pouring concrete into the slab forms to form the slab.

5. The method as recited in claim 4, and further comprising the following steps:

providing unbonded elongated reinforcing elements within a floor slab, the reinforcing elements within the floor slab extending into and terminating in perimeter beams located at a perimeter edge of the floor slab, a first set of the reinforcing elements within the floor slab oriented in a first direction, and a second set of the reinforcing elements within the floor slab oriented in a second direction that is generally orthogonal to the first direction;

providing anchoring elements secured to the perimeter beams for gripping the ends of the reinforcing elements within the floor slab and for effecting a post-tensioning operation on the reinforcing elements within the floor slab; and providing anchoring elements within perimeter columns located at a perimeter edge of the floor slab for gripping the ends of the reinforcing elements in the beams and for effecting a post-tensioning operation on the reinforcing elements in the beams.

* * * * *